United States Patent [19]

Martinmaas

[11] 4,437,364

[45] Mar. 20, 1984

[54] NUT WRENCH

[76] Inventor: Werner W. Martinmaas, 3461 Cashill Blvd., Reno, Nev. 89509

[21] Appl. No.: 235,027

[22] Filed: Feb. 17, 1981

[51] Int. Cl.[3] ..... B25B 13/12

[52] U.S. Cl. ..... 81/179

[58] Field of Search ..... 81/179, 180 C

[56] References Cited

U.S. PATENT DOCUMENTS

| | | | |
|---|---|---|---|
| 577,770 | 2/1897 | Martin . | |
| 879,155 | 2/1908 | Ellis . | |
| 892,503 | 7/1908 | Corbin . | |
| 1,557,864 | 10/1925 | Mull . | |
| 2,565,154 | 8/1951 | Wedvik | 81/179 |
| 2,600,693 | 6/1952 | Rutherford | 81/179 |
| 2,646,711 | 7/1953 | Yavner | 81/179 |
| 2,846,912 | 8/1958 | Day | 81/179 |
| 3,079,820 | 3/1963 | Vantchoura | 81/179 |

*Primary Examiner*—Roscoe V. Parker

*Attorney, Agent, or Firm*—Wood, Dalton, Phillips, Mason & Rowe

[57] ABSTRACT

A nut wrench is constructed to function like a ratchet wrench by forming one of the two jaw members as a slideway which diverges from the gripping face of the other jaw member toward the front of the jaw, mounting on the slideway a slide member which has the second gripping face, and lightly spring-biasing the slide member rearwardly to a normal position. The parts are so proportioned that, when the wrench is engaged with a nut, reverse rotation of the wrench displaces the slide member forwardly until the span across the jaw members is sufficient to override the angles of the nut, after which the spring returns the slide member to its normal position.

20 Claims, 11 Drawing Figures

NUT WRENCH

BACKGROUND OF THE INVENTION

Several adjustable wrenches have been developed which function like a ratchet wrench, in that they need not be disengaged from a bolt head and reengaged on each stroke. One such device is disclosed in applicant's U.S. Pat. No. 4,214,491, issued July 29, 1980. Various others are included in the references cited against that patent.

All such devices known to applicant are characterized by the use of a pivoted lever which acts to disengage the movable jaw from the jaw adjusting mechanism so that during reverse rotation of the wrench the movable jaw may move far enough to permit the wrench jaws to slip over the angles of a bolt head or nut.

No device of the above-described type is applicable to a fixed jaw wrench, and in addition even the best of them require that the user gain some familiarity with the manipulation of the wrench in order that it may function properly.

SUMMARY OF THE INVENTION

The principal object of the present invention is to provide a fixed jaw or adjustable jaw wrench which may function like a ratchet wrench, so that the wrench jaws need not be disengaged from a fastener such as a nut or bolt head when the fastener is being tightened or loosened.

The term "nut wrench" is used herein as a generic term to describe either a fixed jaw or adjustable jaw wrench for rotating objects which have angularly related flat surfaces surrounding an axis of rotation.

The present invention accomplishes the desired purpose by forming one of the two jaw members of a wrench so that it provides a slideway which diverges from the other jaw member toward the front of the jaw. A slide member is mounted for fore-and-aft movement along the slideway, and carries a gripping face which is effectively parallel to the gripping face on the other jaw member, and the second gripping face terminates at a rear face that extends toward the slideway. Spring means on the wrench lightly biases the slide member rearwardly to a normal position.

The angle of divergence of the slideway, the length of the gripping face on the slide member, and the forward travel of the slide member are such that when the gripping faces are engaged with opposite flat surfaces of a fastener to turn the fastener by forward rotation, reverse rotation of the wrench displaces the slide member forwardly against the bias of the spring means a sufficient distance that the span across the jaw members exceeds the width of the nut across opposite apices thereof, whereby the jaw members override the opposite apices and the spring means returns the slide member to its normal position with the gripping face on the slide member in engagement with the next flat surface of the fastener.

In an adjustable jaw wrench, the structure preferably is such that the slide member may move further to the rear of the slideway as the adjustable jaw is moved closer to the fixed jaw for engagement with a smaller size fastener.

In view of the fact that there may be certain circumstances in which it is desirable to use the wrench in an entirely conventional manner, means are provided for locking the slide member against forward movement on the slideway if desired.

THE DRAWINGS

DETAILED DESCRIPTION OF THE INVENTION

Figure 1:
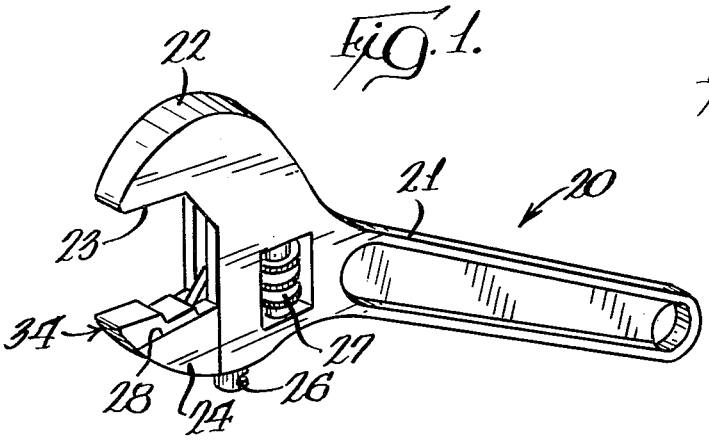
FIG. 1 is a perspective view of an adjustable nut wrench embodying the invention.
Figure 2:
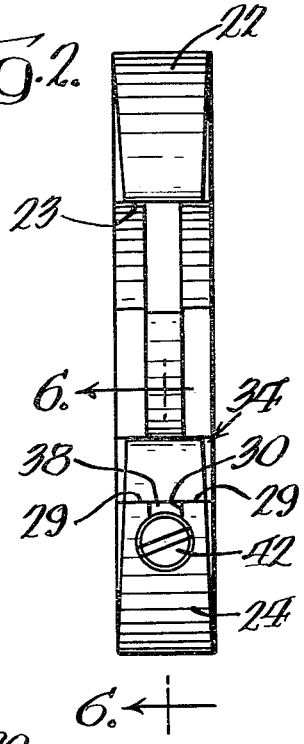
FIG. 2 is a front elevational view of the nut wrench of FIG. 1 on an enlarged scale.

Referring to the drawings, and referring first to FIGS. 1 to 7, a nut wrench, indicated generally at 20, has a handle 21 at the forward end of which is an integral first jaw member 22 having a first gripping face 23. A second jaw member 24 is mounted for sliding movement along a guide 25 and has a rack 26 the teeth of which are engaged by an adjusting screw 27 so that the span across the jaw defined by the jaw members may be adjusted.

Referring now particularly to FIGS. 2 to 4, 6 and 7, the lower jaw member 24 is constructed to provide a slideway 28 having support rails 29 flanking a longitudinal slot 30. The bottom of the longitudinal slot opens into a blind bore 31 which has a rear end 32 and a threaded forward portion 33. The slideway 28 diverges from the first jaw member 22 toward the front of the jaw.

Mounted upon the slideway 28 for fore-and-aft movement is a slide member, indicated generally at 34, which includes a body 35 the top surface of which provides a second gripping face 36 which is effectively parallel to the first gripping face 23 of the first jaw member 22 and which terminates at a rear face 37. Behind the rear face 37 the slide member has a shoe 38 with a central rib **38*a* which extends downwardly through the slot 30 and has at its lower end an integral spring cup 39 which is slidable in the blind bore 31. In the normal position of the slide member 34 a rear wall 40 of the spring cup abuts the end 32 of the blind bore 31**.

Figure 7:
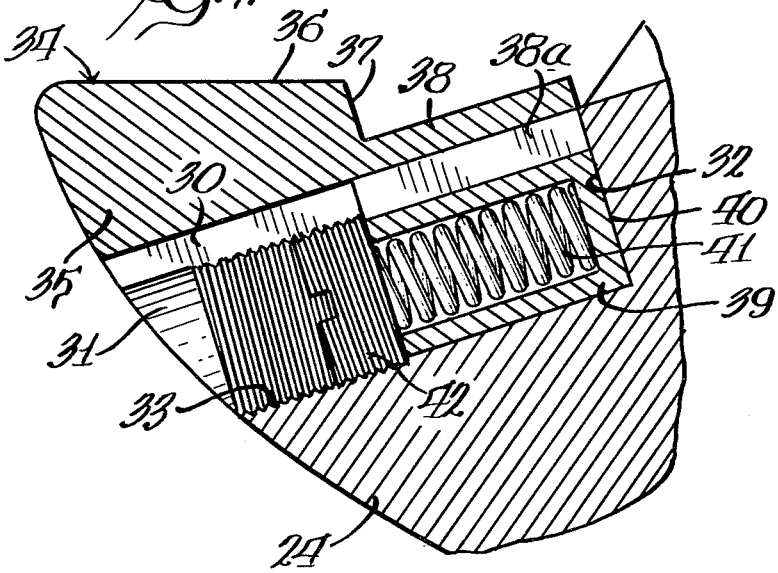
FIG. 7 is a view similar to FIG. 6 illustrating the spring retainer positioned to lock the slide member against movement along the slideway.

A compression spring 41 in the spring cup 39 is confined by a threaded plug 42 which screws into the threaded forward end portion 33 of the blind bore 31; and as seen in FIG. 7, the plug 42 may be screwed far enough into the bore to clamp the spring cup 39 against the rear end 32 of the bore and thus lock the slide member 34 against forward movement on the slideway 28.

Figure 3:
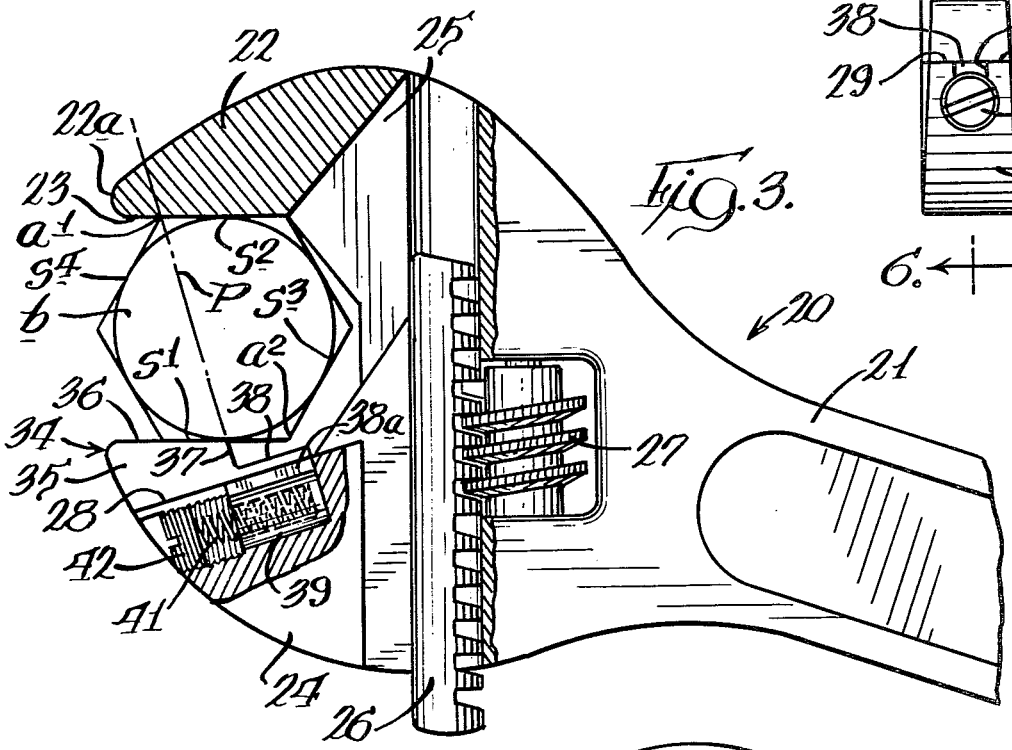
FIG. 3 is a fragmentary side elevational view, partly in section, of the nut wrench of FIG. 1 with the jaws in their normal position gripping a bolt head for rotating the bolt by clockwise rotation.

Referring now particularly to FIG. 3, the nut wrench 20 is illustrated with the gripping faces 36 and 23 engaged with opposite flat surfaces $s^1$ and $s^2$ of a bolt head b, so that the bolt may be turned by forward (clockwise) rotation of the nut wrench. The slide member 34 is in its normal position, and in that position it is seen that the rear face 37 of the slide member 34 is substantially at the center of the bolt surface $s^1$ and that a projection p of the face 37 intersects an apex $a^1$ of the bolt head b which is closest to the front 22*a* of the first jaw member 22. Likewise, the rear face 37 is perpendicular to the slideway 28.

Particularly in an adjustable wrench the foregoing dimensional and angular relationships are not completely critical, because of the substantial amount of play between the movable jaw member 24 and the guide 25 in such wrenches, so that minor deviations from the above-described relationship are not fatal to the successful operation of the device.

Figure 4:
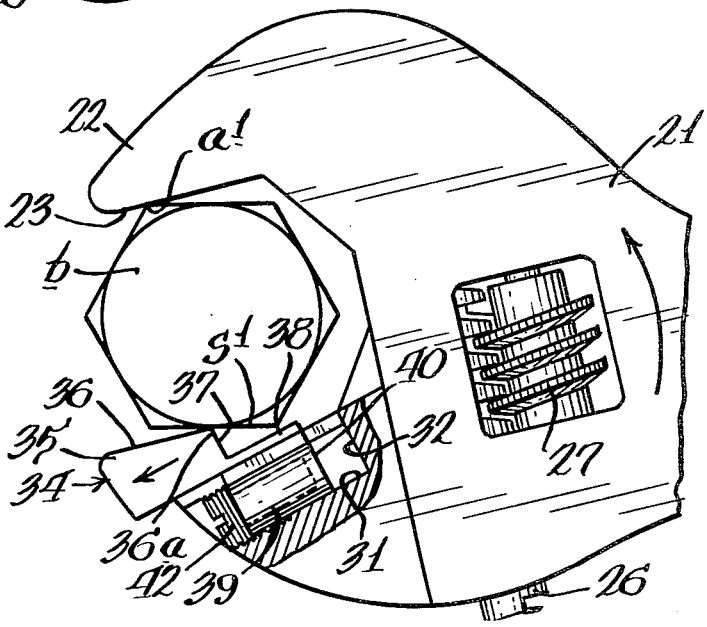
FIG. 4 is a fragmentary elevational view, partly in section, illustrating the positions occupied by the parts as reverse rotation of the wrench on the bolt head is commenced.
Figure 5:
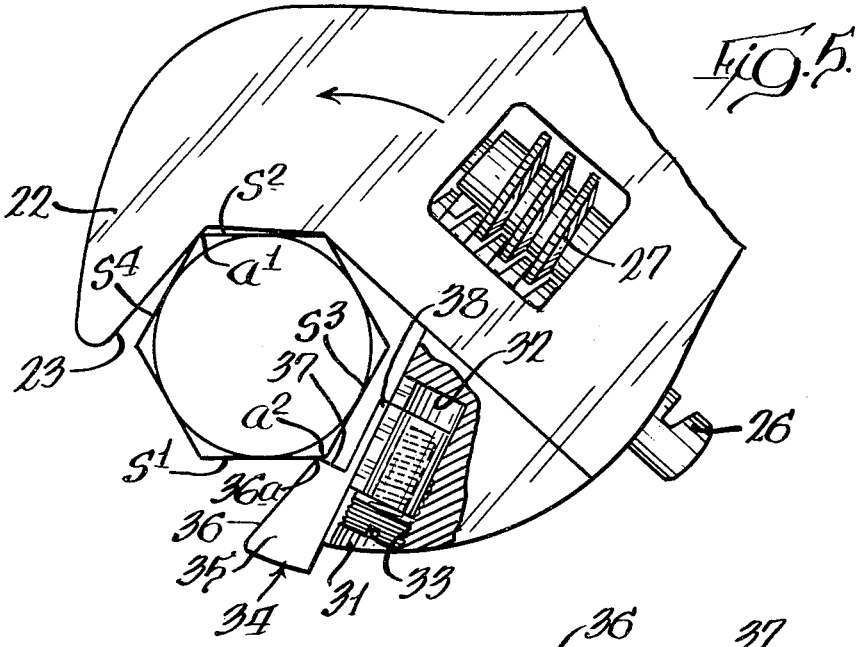
FIG. 5 is a view similar to FIG. 4 illustrating the position of the parts just before the wrench jaw slips around the opposite apices of the bolt head.
Figure 6:
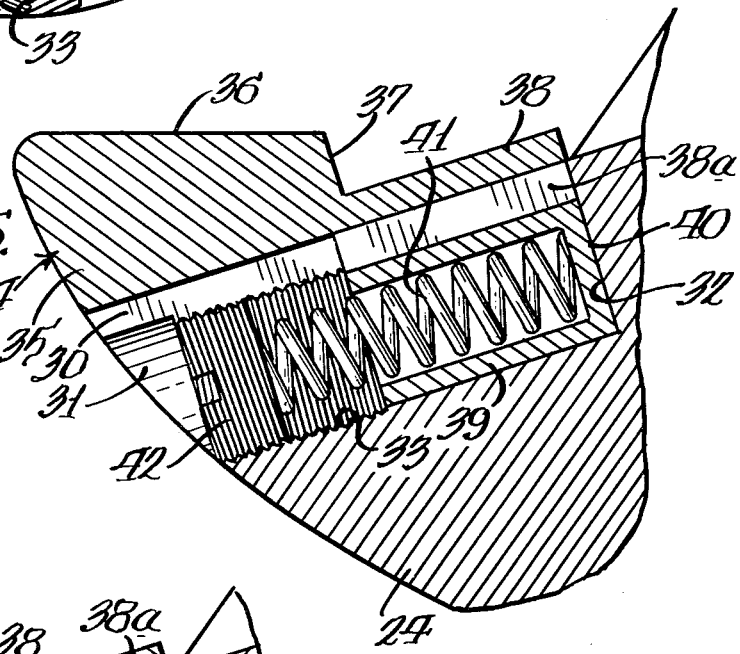
FIG. 6 is a fragmentary sectional view on an enlarged scale illustrating the slideway, the slide member, the spring and the adjustable spring retainer when the slide member is in its normal position.

When the wrench is rotated in a reverse direction, as indicated by the arrows in FIGS. 4 and 5, the first gripping face 23 pivots around the bolt head apex $a^1$ which increases the angle between the bolt surface $s^1$ and the rear face 37 of the slide member 34, so that a camming action displaces the slide member forwardly against the bias of the compression spring 41. As reverse rotation of the wrench continues as shown in FIG. 5, the first gripping face 23 slides over the bolt head apex $a^1$ and the rear edge 36*a* of the slide member 34, formed by the junction of the gripping face 36 and the rear face 37, slides along the bolt head surface $s^1$ until the margin 36*a* clears a bolt head apex $a^2$ which is at the rear of the bolt head surface $s^1$. It is able to do this because the span across the jaw is greater than the width of the nut across the opposite apices $a^1$–$a^2$. When the edge 36*a* slips around the apex $a^2$, the spring 41 returns the slide member 34 to its normal position, and the gripping faces 23 and 36 are in engagement with the next flat surfaces $s^3$ and $s^4$ of the bolt head.

It is apparent that if the rear face 37 of the slide member 34 is much to the rear of the centerline of the bolt head surface $s^1$ in the normal position of FIG. 3, during reverse rotation the angle between the fulcrum at $a^1$ and the rear gripping face edge 36*a* will be too great for the necessary camming action to occur. Conversely, if the edge 36*a* is much farther forward than is illustrated in FIG. 3, the travel of the slide member 34 will be insufficient for the rear edge 36*a* to slip around the bolt head apex $a^2$.

Figure 8:
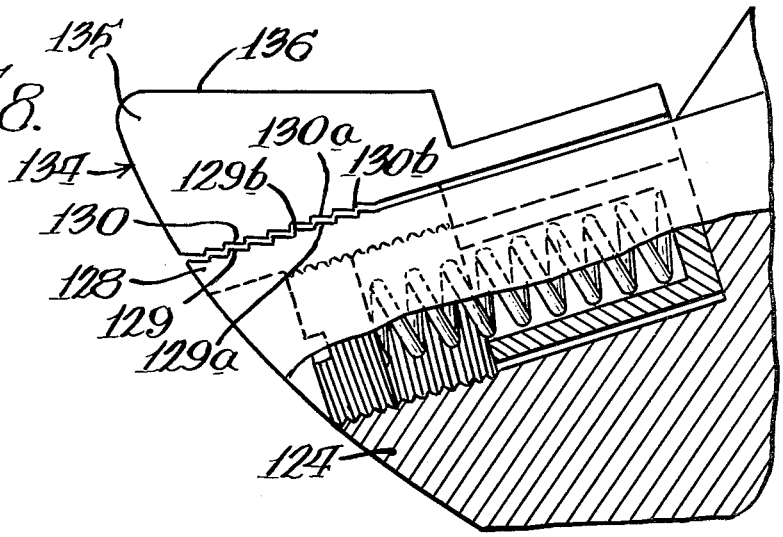
FIG. 8 is a fragmentary view, partly in section, similar to FIG. 6 and illustrating a minor modification of the slideway and slide member structure.

Referring now to FIG. 8, the modified structure there illustrated is identical with that previously described except for the fact that a slideway 128 on a movable jaw member 124 has its upper surface provided with teeth 129; and the body 135 of a slide member 134 has its bottom surface provided with teeth 130 which mesh with the teeth 129 of the slideway. The teeth 129 have top facets 129*a*, and the teeth 130 have matching bottom facets 130*a*, all of which extend upwardly from the rear toward the front at a very small angle (2° is satisfactory). Apices 129*b* of the teeth 129 and 130*b* of the teeth 130 are right angles.

When a gripping surface 136 of the slide member 134 is engaged with a nut as illustrated in FIG. 3, the facets 130*a* are in engagement with the facets 129*a* so that the very slight upward incline of those facets from rear to front eliminates any tendency of the slide member 134 to slip forward during forward rotation of the wrench.

Figure 9:
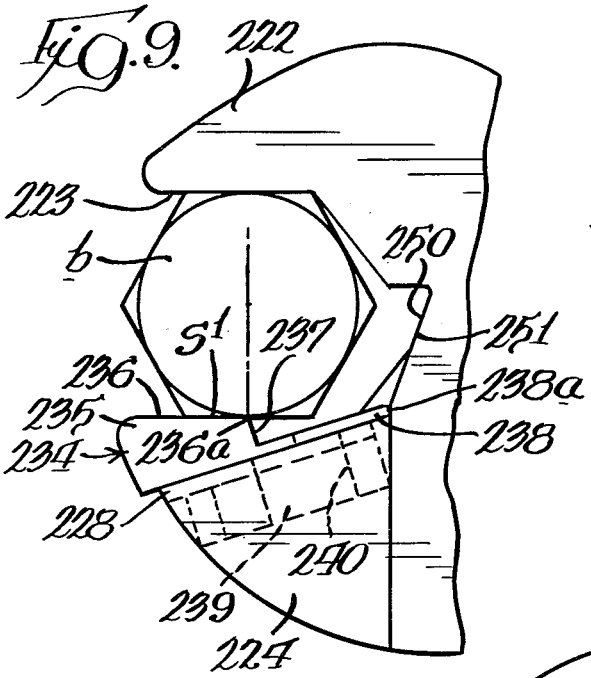
FIG. 9 is a fragmentary side elevational view illustrating a modified structure which is preferred for an adjustable wrench.
Figure 10:
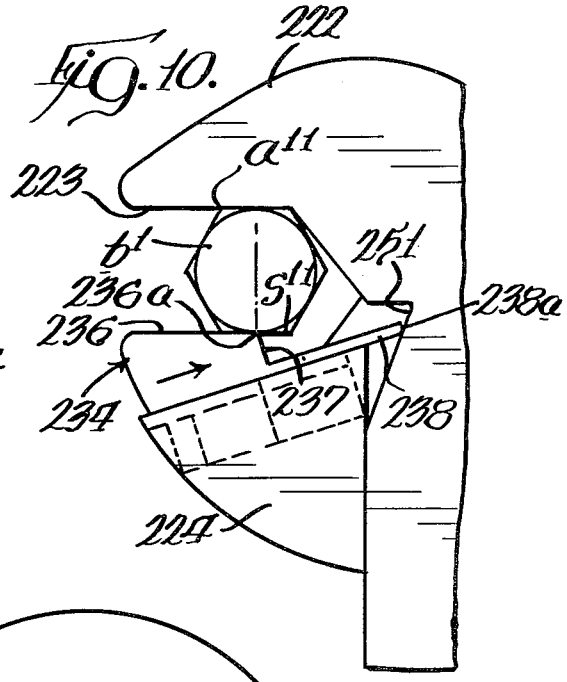
FIG. 10 is a view like FIG. 9 which illustrates the position of the part when the wrench jaws are closed upon a bolt head of smaller diameter than that illustrated in FIG. 9.

Referring now to FIGS. 9 and 10, an adjustable wrench is similar to that illustrated in FIGS. 1 to 7 in that it has a fixed first jaw, here numbered 222, and a movable second jaw, here numbered 224, and a slide member, here indicated generally at 234. In the modification illustrated in FIGS. 9 and 10, a part of the wrench that is traversed by a slideway 228 during adjustment of the jaw 224 is provided with a recess 250 having a rear guide surface 251 which extends diagonally rearwardly from the line of movement of the second jaw member 224 toward the plane of the first gripping face 223.

A slide member 234 is provided with a rearward shoe 238 which extends a substantial distance to the rear of the rear end 240 of a spring cup 239 on the slide member, and a tip 238*a* on the shoe 238 slides along the rear guide surface 251, as may be seen by comparing FIGS. 9 and 10. The angle of the guide surface 251 relative to the line of movement of the movable jaw member 224 is such that a rear edge 236*a* of a slide member body 235 is at the centerline of a gripped face $s^{11}$ of a small bolt head $b^1$ which is gripped between a first gripping face 223 and a second gripping face 236, and a rear face 237 of the slide member 234 is substantially on a plane from that midpoint through an apex $a^{11}$ of the bolt head $b^1$ when the slide member is in its illustrated normal position gripping the small bolt head $b^1$.

Figure 11:
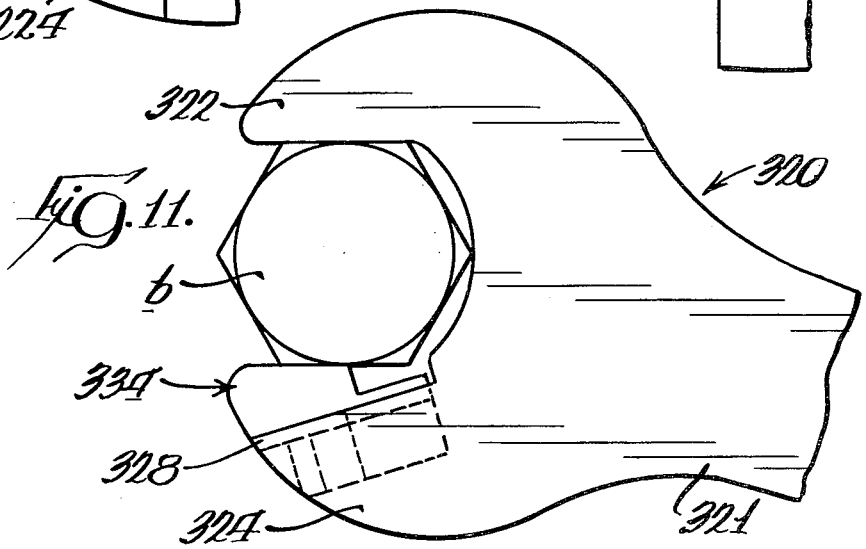
FIG. 11 illustrates the invention as applied to a fixed jaw wrench.

Referring now to FIG. 11, in which the invention is illustrated as applied to a fixed jaw wrench 320, a wrench handle 321 has a fixed first jaw 322 and a fixed second jaw 324 at its forward end. As is usual in such wrenches, the span across the jaws is appropriate to fit opposite faces of a bolt head b of some standard size.

The lower jaw 324 has a slideway 328 which is identical with the slideway 28, and a slide member 334 is identical with the slide member 34 of the first embodiment. Accordingly, no further description of the structure of FIG. 11 is necessary.

The foregoing detailed description has been given for clearness of understanding only, and no unnecessary limitations should be understood therefrom as modifications will be obvious to those skilled in the art.

I claim:

1. In a wrench for rotating a fastener having angularly related flat surfaces surrounding an axis of rotation, said wrench having a handle, a first jaw member with a first gripping face and a second jaw member with a second gripping face effectively parallel to said first gripping face, and said faces defining a forwardly open jaw to slidably engage extensive parts of opposite flat surfaces of a fastener to turn said fastener during forward rotation of the wrench, and improvement which permits the wrench to be reverse rotated without turning the fastener, said improvement comprising:

the second jaw member provides a slideway which diverges from the first jaw member toward the front of the jaw;

a slide member mounted for fore-and-aft movement along said slideway, said slide member having said second gripping face thereon which engages a substantial part but less than the entirety of one of said flat surfaces of a fastener, and said second gripping face terminating at a rear face that extends toward the slideway at an angle to the second gripping face, said rear face defining the front of a recess which also has a lower defining surface, the dimensions of said recess being great enough and the relationship between said rear face and said lower defining surface being such that during reverse rotation of the wrench an apex of a fastener may be received in said recess free of contact with either defining surface thereof;

and spring means on the wrench lightly biasing said slide member rearwardly to a normal position;

the angle of divergence of the slideway, the length of the second gripping face, and the forward travel of the slide member being such that reverse rotation of the wrench while engaged with opposite flat surfaces of a fastener causes one of said flat surfaces to pivot about the slide member apex between said second gripping face and said rear face while the fastener apex that defines the rear of said one of said flat surfaces is received in said recess free of contact with the slide member and thus cam the slide member forwardly against the bias of the spring means a sufficient distance that the jaw members span said fastener apex and the directly opposite fastener apex during said reverse rotation, whereby the jaw members override said opposite apices and the spring means returns the slide member to its normal position with the second gripping face in engagement with the next flat surface of the fastener.

2. The improvement of claim 1 in which the slideway has support rails flanking a longitudinal slot, there is a blind bore in the front of the second jaw member into which said slot opens, the slide member has a rib in the slot and an integral spring cup in the bore, said spring cup having a rear wall which may bear upon the end of the bore, a compression spring seats in said spring cup, and a plug in the forward portion of the bore confines the compression spring.

3. The improvement of claim 2 in which the forward part of the bore and the plug are threaded so the plug may be screwed into contact with the front of the spring cup to lock the slide member against forward movement.

4. The improvement of claim 2 in which the rear face of the slide member is perpendicular to the slideway, and a projection of said rear face toward the first gripping face intersects the apex of the fastener which is adjacent the front of said first gripping face.

5. The improvement of claim 1 in which the rear face of the slide member is perpendicular to the slideway and a projection of said rear face toward the first gripping face intersects the apex of the fastener which is adjacent the front of said first gripping face.

6. The improvement of claim 1 in which the slideway and the slide member have shallow teeth each of which has a forward facet and a top facet which are substantially at right angles to one another, and the top facets of said teeth are inclined upwardly toward the front at a very small angle to the parallel planes of the gripping faces, whereby said teeth interengage with a fastener during forward rotation of the wrench and disengage during reverse rotation.

7. The improvement of claim 2 in which the slideway and the slide member have shallow teeth each of which has a forward facet and a top facet which are substantially at right angles to one another, and the top facets of said teeth are inclined upwardly toward the front at a very small angle to the parallel planes of the gripping faces, whereby said teeth interengage with a fastener during forward rotation of the wrench and disengage during reverse rotation.

8. The improvement of claim 1 which is provided with movable means for locking the slide member against forward movement on the slideway.

9. The improvement of claim 1 in which the rear face of the slide member in normal position lies substantially along a plane which is perpendicular to the slideway and which extends through the midpoint of the fastener face that is gripped by the second gripping face and through the fastener apex adjacent the front of the first gripping face.

10. The improvement of claim 2 in which the rear face of the slide member in normal position lies substantially along a plane which is perpendicular to the slideway and which extends through the midpoint of the fastener face that is gripped by the second gripping face and through the fastener apex adjacent the front of the first gripping face.

11. In a wrench for rotating a fastener having angularly related flat surfaces surrounding an axis of rotation, said wrench having a handle, a first jaw member integral with the handle, said first jaw member having a first gripping face, a second jaw member with a second gripping face effectively parallel to said first gripping face, said faces defining a forwardly open jaw to slidably engage extensive parts of opposite flat surfaces of a fastener, and means for adjusting the second jaw member linearly relative to the first jaw member to vary the space between the gripping faces for gripping fasteners of different sizes, the improvement comprising:

the second jaw member provides a slideway which diverges from the first member toward the front of the jaw;

a recess in the handle is traversed by the slideway as the second jaw member is adjusted, said recess having a rear guide surface which extends diagonally rearwardly from the line of movement of the second jaw member toward the plane of the first gripping face;

a slide member mounted for fore-and-aft movement along said slideway, said slide member having said second gripping face thereon which engages a substantial part but less than the entirety of one of said flat surfaces of a fastener, and said second gripping face terminating at a rear face that extends toward the slideway and defines one margin of a recess toward the rear of said slide member;

an integral rearwardly extending guide shoe at the rear of the slide member which bears on said guide surface so the slide member may move closer to the rear of the slideway as the second jaw member moves toward the first jaw member to grip smaller fasteners;

and spring means on the wrench lightly biasing said slide member rearwardly to a normal position;

the angle of divergence of the slideway, the length of the second gripping face, and the forward travel of the slide member being such that when said first and second gripping faces are engaged with opposite flat surfaces of a fastener to turn the fastener by forward rotation, reverse rotation of the wrench causes the apex between said second gripping face and said rear face to pivot on one of the flat surfaces of a fastener to cam the slide member forwardly against the bias of the spring means a sufficient distance that the span across the jaw members exceeds the width of the fastener across opposite apices thereof, and one of said opposite apices being received in said recess free of contact with the slide member during said reverse rotation, whereby the jaw members override said opposite apices and the spring means returns the slide member to its normal position with the second gripping face in engagement with the next flat surface of the fastener.

12. The improvement of claim 11 in which the rear face of the slide member is perpendicular to the slideway and a projection of said rear face toward the first gripping face intersects the apex of the fastener which is adjacent the front of said first gripping face.

13. The improvement of claim 11 in which the slideway and the slide member have shallow teeth each of which has a forward facet and a top facet which are substantially at right angles to one another, and the top facets of said teeth are inclined upwardly toward the front at a very small angle to the parallel planes of the gripping faces, whereby said teeth interengage with a fastener during forward rotation of the wrench and disengage during reverse rotation.

14. The improvement of claim 11 which is provided with movable means for locking the slide member against forward movement on the slideway.

15. The improvement of claim 11 in which the rear face of the slide member in normal position lies substantially along a plane which is perpendicular to the slideway and which extends throught the midpoint of the fastener face that is gripped by the second gripping face and through the fastener apex adjacent the front of the first gripping face.

16. The improvement of claim 11 in which the sideway has support rails flanking a longitudinal slot, there is a blind bore in the front of the second jaw member into which said slot opens, the slide member has a rib in the slot and an integral spring cup in the bore, said spring cup having a rear wall which may bear upon the end of the bore, a compression spring seats in said spring cup, and a plug in the forward portion of the bore confines the compression spring.

17. The improvement of claim 16 in which the forward part of the bore and the plug are threaded so the plug may be screwed into contact with the front of the spring cup to lock the slide member against forward movement.

18. The improvement of claim 16 in which the rear face of the slide member is perpendicular to the slideway, and a projection of said rear face toward the first gripping face intersects the apex of the fastener which is adjacent the front of said first gripping face.

19. The improvement of claim 16 in which the slideway and the slide member have shallow teeth each of which has a forward facet and a top facet which are substantially at right angles to one another, and the top facets of said teeth are inclined upwardly toward the front at a very small angle to the parallel planes of the gripping faces, whereby said teeth interengage with a fastener during forward rotation of the wrench and disengage during reverse rotation.

20. The improvement of claim 16 in which the rear face of the slide member in normal position lies substantially along a plane which is perpendicular to the slideway and which extends through the midpoint of the fastener face that is gripped by the second gripping face and through the fastener apex adjacent the front of the first gripping face.

* * * * *